US006634332B2

(12) United States Patent
Saito et al.

(10) Patent No.: US 6,634,332 B2
(45) Date of Patent: Oct. 21, 2003

(54) ENGINE START-STOP CONTROL SYSTEM

(75) Inventors: Mikio Saito, Motosu-gun (JP); Masahiko Osada, Okazaki (JP); Toshihisa Ishihara, Okazaki (JP)

(73) Assignee: Denso Corporation, Kariya (JP)

( * ) Notice: Subject to any disclaimer, the term of this patent is extended or adjusted under 35 U.S.C. 154(b) by 85 days.

(21) Appl. No.: 09/925,317

(22) Filed: Aug. 10, 2001

(65) Prior Publication Data

US 2002/0017260 A1 Feb. 14, 2002

(30) Foreign Application Priority Data

Aug. 10, 2000 (JP) ..... 2000-242411
Apr. 4, 2001 (JP) ..... 2001-106342

(51) Int. Cl.[7] ..... F02N 11/00
(52) U.S. Cl. ..... 123/179.3; 290/38 R
(58) Field of Search ..... 123/179.3; 290/38 R, 290/38 C, 38 E; 701/36; 361/152

(56) References Cited

U.S. PATENT DOCUMENTS

| | | | | |
|---|---|---|---|---|
| 5,383,428 A | | 1/1995 | Fasola et al. | 123/179.3 |
| 5,970,937 A | | 10/1999 | Casellato et al. | 123/179.3 |
| 6,050,233 A | * | 4/2000 | Vilou | 123/179.3 |
| 6,249,419 B1 | * | 6/2001 | Casellato | 361/160 |
| 6,323,562 B1 | * | 11/2001 | Renner et al. | 290/38 A |
| 2002/0014216 A1 | * | 2/2002 | Boegner et al. | 123/179.3 |

FOREIGN PATENT DOCUMENTS

| | | | |
|---|---|---|---|
| DE | 3918351 C2 | | 12/1989 |
| DE | 4344355 A1 | | 7/1994 |
| DE | 19702932 A1 | | 7/1998 |
| DE | 19810954 A1 | | 9/1999 |
| DE | 19840819 C1 | | 8/2000 |
| JP | 61-101672 | | 5/1986 |
| JP | B2-2-11741 | | 3/1990 |
| JP | B2-6-3176 | | 1/1994 |
| JP | B2-7-42909 | | 5/1995 |
| WO | WO 98/32966 | * | 7/1998 |

* cited by examiner

*Primary Examiner*—Henry C. Yuen
*Assistant Examiner*—Arnold Castro
(74) *Attorney, Agent, or Firm*—Oliff & Berridge, PLC

(57) ABSTRACT

An engine start-stop control system for an automotive vehicle includes a first step for supplying current to a solenoid of a magnet switch of a starter at 100% duty ratio until a first predetermined time passes, a second step for supplying current to the solenoid at a duty ratio that is less than 100% after the first predetermined period passes until a second predetermined period passes, and a third step for supplying current to the solenoid at 100% duty ratio after the second predetermined period passes until a third predetermined period passes. Therefore, a pinion of the starter reaches a ring gear of the engine in a short time and engages the ring gear with a moderate impacting shock, thereby preventing the pinion and the ring gear from being damaged.

9 Claims, 3 Drawing Sheets

ENGINE START-STOP CONTROL SYSTEM

CROSS REFERENCE TO RELATED APPLICATION

The present application is based on and claims priority from Japanese Patent Applications 2000-242411, filed Aug. 10, 2000 and 2001-106342, filed Apr. 4, 2001, the contents of which are incorporated herein by reference.

BACKGROUND OF THE INVENTION

1. Field of the Invention

The present invention relates to an engine start-stop control system for an automotive vehicle.

2. Description of the Related Art

In order to protect environment and natural resource, it is recommended to stop the engine of an automotive vehicle while the vehicle is waiting for the traffic signal to change. For this purpose, an automatic engine start-stop control system has been developed. Such an automatic engine start-stop control system automatically stops the engine when a driver stops the vehicle with the engine running at an idle speed (hereinafter referred to as the idle stop operation) and automatically starts the engine when the driver operates an existing lever or pedal, such as an acceleration pedal, to start the vehicle. Therefore, it is necessary for the engine start-stop control system to stop and start an engine without delay in order to prevent traffic jam.

JP-B2-7-42909 discloses such an engine start-stop control system, in which current supplied to the solenoid of a magnet switch is gradually increased until the main contact thereof closes and is gradually reduced after the main contact has closed to start the engine. The above engine start-stop control system moderates the speed of the pinion of the starter engaging with the ring gear of the engine, so that the pinion and the ring gear can be prevented from being damaged.

However, since the pinion moves toward a ring gear of the engine at a low speed, it takes a considerable time for the pinion to engage the ring gear. If terminal voltage of a vehicle battery becomes lower than a normal level due to over-discharge thereof, the engagement speed may become so long that traffic jam is caused.

SUMMARY OF THE INVENTION

Therefore, a main object of the invention is to provide an improved engine start-stop control system that can stop and start engine without delay and without damage to the starter and the engine.

According to a main feature of the invention, an engine start-stop control system for an automotive vehicle includes first means for supplying current to a solenoid of a magnet switch of a starter motor at 100% duty ratio until a first predetermined time passes; and second means for supplying current to the solenoid at a duty ratio that is less than 100% after the first predetermined period passes until a second predetermined period passes.

Therefore, the current supplied to the solenoid generates sufficient force to pull a plunger of the magnet switch, which brings the pinion near a ring gear of the engine in a short time. Then, the current is controlled to a low level just before the pinion engages the ring gear to reduce the pulling force of the plunger so that the impacting speed of the pinion can be reduced. As a result, impacting shock given to the pinion and the ring gear is moderated, and the lifetime thereof is increased.

The above system may have third means for supplying current to the solenoid at 100% duty ratio after the second predetermined period passes until a third predetermined period passes. As soon as the pinion is brought in contact with the ring gear, the pulling force of the solenoid is increased so that the pinion is further urged, via the plunger, to engage the ring gear completely. This shortens the time to start the engine and also eases the engagement stress at a limited portion, which may be damaged because of incomplete engagement due to insufficient urging force.

The above system may have fourth means for controlling at least one of the first, second and third predetermined periods according to voltage level of said battery or an amount of current supplied to the solenoid. Accordingly, even if the battery terminal voltage is comparatively low, the system can operate properly.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
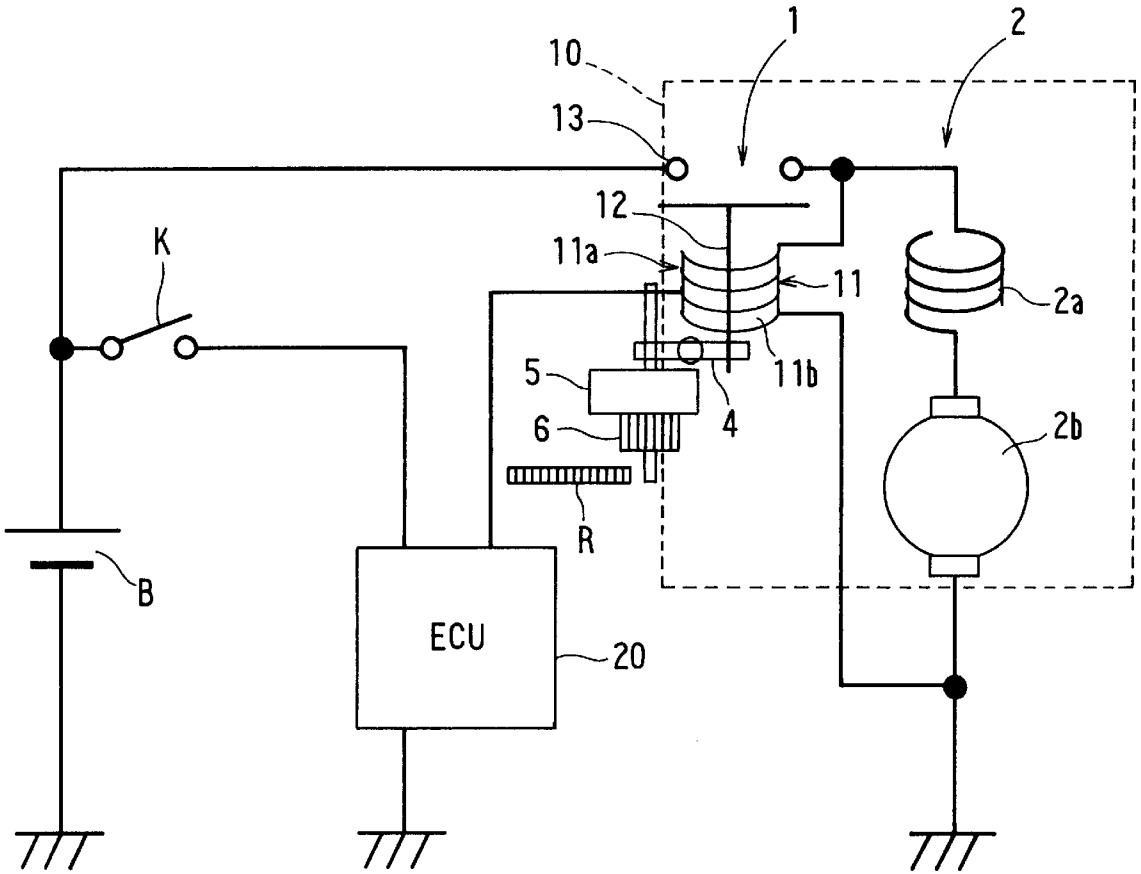
FIG. 1 is a schematic circuit diagram of an engine start-stop control system according to a preferred embodiment of the invention.

As shown in FIG. 1, an engine start-stop system is comprised of a starter 10, an ECU 20, a battery and a key switch K. The starter 10 is comprised of a magnet switch, 1, a pinion-driving motor 2, a pinion 6 and a planetary-gear type speed reduction unit (not shown).

The magnet switch 1 is comprised of a plunger-pulling solenoid 11, a pinion control plunger 12 and a main switch 13 that has a pair of contacts. The pinion 6 engages a ring gear R of an engine when the plunger-pulling solenoid 11 pulls the plunger 12 and the main switch 13 closes to operate the motor 2, which sends the pinion toward the ring gear R.

Figure 2:
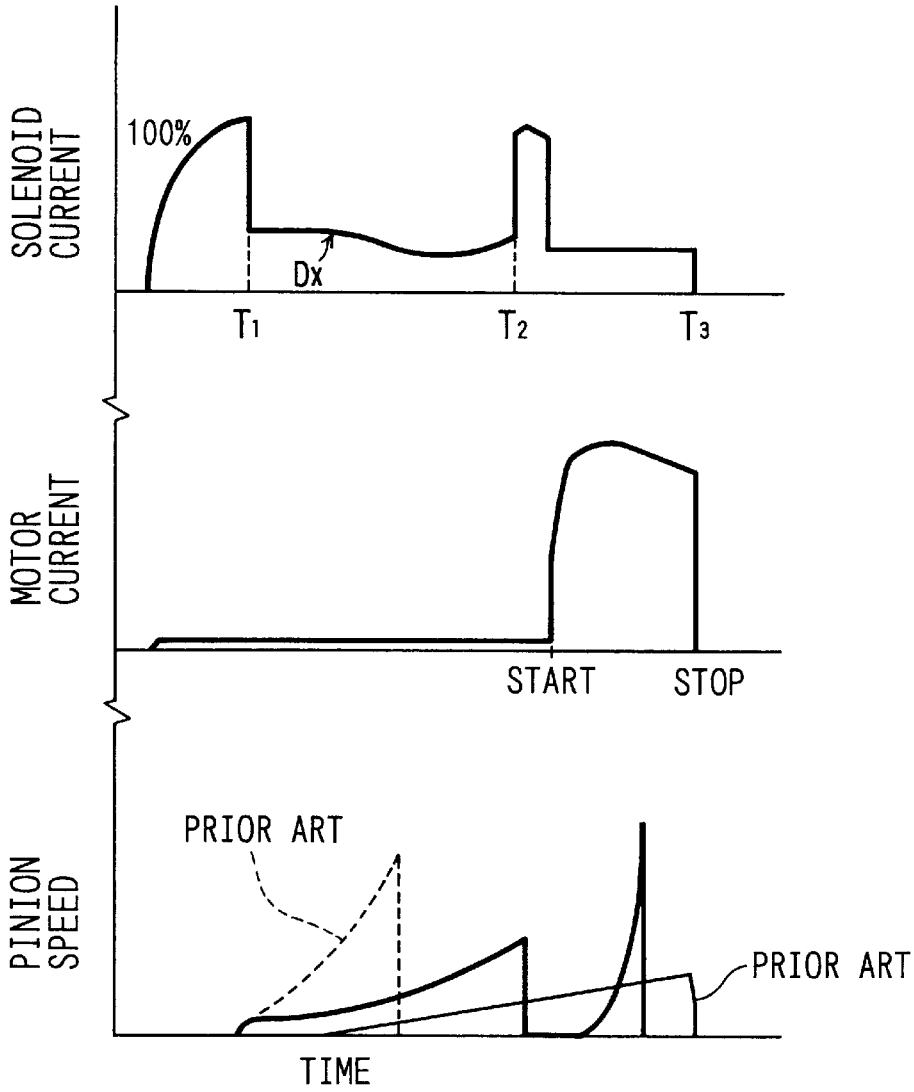
FIG. 2 is a timing chart of operation of the engine start-stop control system according to the preferred embodiment of the invention.

The ECU 20 controls the current supplied to the solenoid 11, as shown in FIG. 2.

The solenoid 11 is supplied with a full level or 100% duty ratio current at a first stage, a low level after a predetermined time and the full level or 100% duty ratio current when the pinion 6 has been brought in contact with the ring gear R. The solenoid 11 is comprised of a pull-in coil 11*a* and a hold coil 11*b*, which are connected to each other as shown in FIG. 1. The pull-in coil 11*a* and the hold coil 11*b* are wound around a common magnetic core so as to move the plunger 12, closes the pair of contacts of the main switch 13 and swings an end of the drive lever 4 when current is supplied thereto. The pull-in coil 11*a* is connected at an end to a field coil 2*a* of the motor 2 and to the drive transistor of the ECU 20 at the other end. The hold coil 11*b* is connected to a drive transistor of the ECU 20 at an end and to a ground at the other end.

Figure 3:
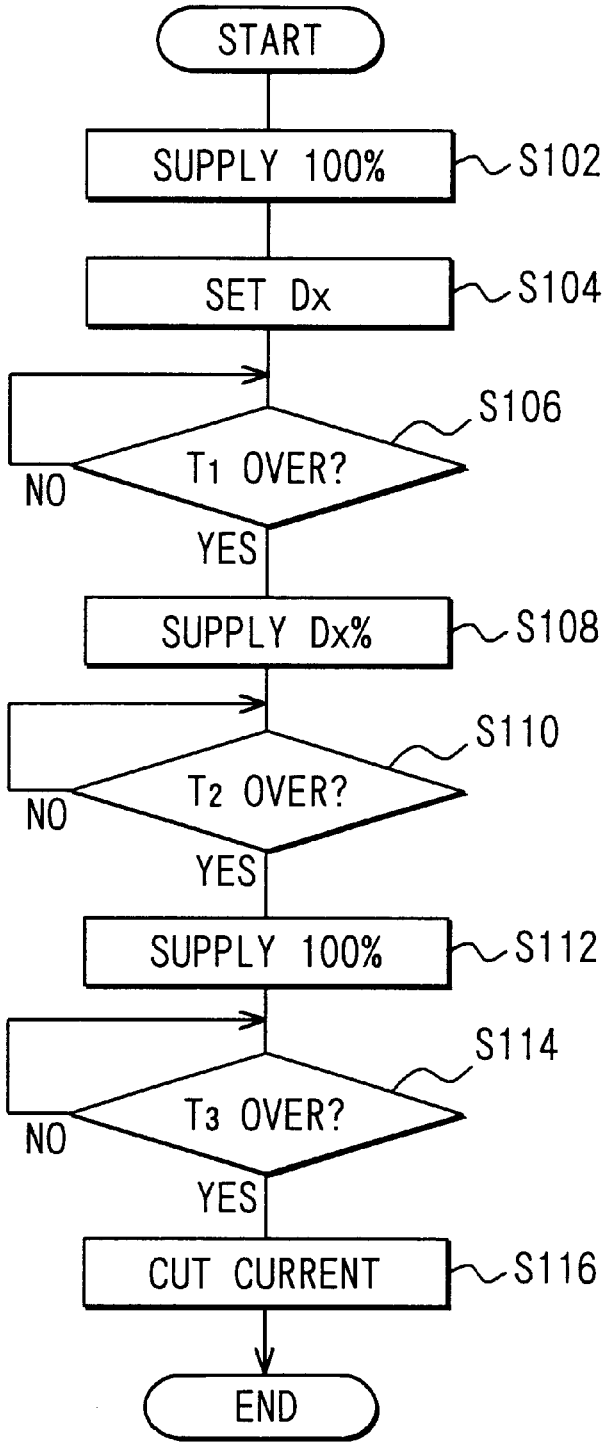
FIG. 3 is a flow diagram of operation of the engine start-stop control system according to the preferred embodiment of the invention.

The drive transistor has a pair of electrodes, one of which is connected to the battery B via the ignition key switch K and the other of which is connected to the solenoid 11. The ECU 20 controls current supplied to the solenoid 11 by the drive transistor in a P.W.M (pulse width modulation) current) control manner according to an engine-start-routine shown in FIG. 3 when the ignition key switch K is turned on or when the accelerator pedal is operated after the idle stop operation.

At first, the solenoid 11 is supplied with current at 100% duty ratio at S102. Accordingly, both pull-in coil 11*a* and hold coil 11*b* generates a large pulling force so that the plunger 11, the one-way clutch 5 and pinion 6 can be moved in the axial direction in a short time.

At the next step S104, a control duty ratio Dx is set according to temperature, battery terminal voltage, etc., with reference to a map that is held in the ECU 20. The map has data of various combination of the temperature and battery terminal voltage for controlling current at a low control level, i.e. at the duty ratio of Dx %.

At S106, whether a first predetermined time T1 has passed or not after the solenoid 11 was first energized is checked. If the result is No, the 100% duty ratio is maintained.

On the other hand, at S108, the solenoid 11 is supplied with current at the control duty ratio Dx % if the result is YES. Accordingly, the pulling force is reduced and the pinion 6 slows down the moving speed toward the ring gear R to engage without a large shock.

The first predetermined period T1 may be changed according to the terminal voltage of the battery B or an amount of the current supplied to the solenoid. If the terminal voltage of the battery B or the amount of the current is lower than a normal level, the first predetermined period T1 is increased to prevent the pinion 6 from delaying to engage the ring gear R. In this case the ECU 20 is equipped with a voltage sensor and a control logic therein.

Thereafter, whether a second predetermined time T2 (T2>T1) has passed after the solenoid 11 was first energized or not is checked at S110. If the result is NO, the solenoid 11 is continuously supplied with current at the control duty ratio Dx. On the other hand, the solenoid 11 is supplied with current at 100% duty ratio again if the result is YES at S112. This step is preferably carried out just when the pinion 6 has been brought in contact with the ring gear R, because the pinion 6 can fully engage the ring gear under the full pulling force of the solenoid 11.

Thereafter, the plunger 12 brings the movable contact of the magnet switch 1 in contact with the stationary contact so that current is supplied from the battery to the motor 2, thereby rotating the pinion 6, the ring gear R and the engine.

Since the pinion 6 and the ring gear R fully engage each other, the engine driving force can be transmitted to the engine smoothly and without damage. Even if there is some dispersion of clearance between the pinion 6 and the ring gear R, the engine can be started without any problem.

When the magnet switch 1 is closed, the opposite terminals of the pull-in coil 11*a* are short-circuited. Accordingly, only the hold circuit 11*b* is continuously energized.

Thereafter, whether a third predetermined time T3 (T3>T2) has passed or not is checked at S114. If the result is No, the hold coil 11*b* of the solenoid is continuously supplied with current at 100% duty ratio. On the other hand, the current to be supplied to the solenoid 11 is cut (0% duty ratio) if the result is YES at S116.

Instead of using a timer, the duty ratio can be changed according to the amount of current to be supplied to the solenoid 11.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. An engine start-stop control system for an automotive vehicle including a battery, an engine having a ring gear, a starter having a motor, a pinion, and a magnet switch having a plunger and a solenoid for driving said pinion to engage said ring gear, said engine start-stop control system, comprising:

first means for supplying current to said solenoid at 100% duty ratio until a first predetermined time passes; and second means for supplying current to said solenoid at a duty ratio that changes according to a vehicle condition within a value less than 100% after said first predetermined period passes until a second predetermined period passes.

2. The engine start-stop control system as claimed in claim 1, further comprising third means for supplying current to said solenoid at 100% duty ratio after said second predetermined period passes until a third predetermined period passes.

3. The engine start-stop control system as claimed in claim 1, further comprising fourth means for controlling at least one of said first, second and third predetermined periods according to voltage level of said battery.

4. The engine start-stop control system as claimed in claim 1, further comprising fifth means for controlling at least one of said first, second and third predetermined periods according to an amount of current supplied to said solenoid.

5. A method of starting and stopping an engine having a ring gear for an automotive vehicle and a battery by a starter having a motor, a pinion, and a magnet switch having a plunger and a solenoid for driving said pinion to engage said ring gear, said method comprising the steps of:

supplying current to said solenoid at 100% duty ratio until a first predetermined time passes; and supplying current to said solenoid at a duty ratio that changes according to a vehicle condition within a value less than 100% after said first predetermined period passes until a second predetermined period passes.

6. The method as claimed in claim 5, further comprising the step of supplying current to said solenoid at 100% duty ratio after said second predetermined period passes until a third predetermined period passes.

7. The method as claimed in claim 5, further comprising the step of controlling at least one of said first, second and third predetermined periods according to voltage level of said battery.

8. The method as claimed in claim 5, further comprising the step of controlling at least one of said first, second and third predetermined periods according to an amount of current supplied to said solenoid.

9. The engine start-stop control system as claimed in claim 1, wherein said second means comprises a map having data for controlling current supplied to said solenoid according to various vehicle conditions.

* * * * *